US005467501A

United States Patent [19]

Sepke

[11] Patent Number: 5,467,501

[45] Date of Patent: Nov. 21, 1995

[54] VACUUM CLEANER WITH ILLUMINATED BELT VIEW

[75] Inventor: Arnold L. Sepke, Hudson, Ill.

[73] Assignee: White Consolidated Industries, Inc., Cleveland, Ohio

[21] Appl. No.: 259,144

[22] Filed: Jun. 10, 1994

Related U.S. Application Data

[63] Continuation of Ser. No. 8,739, Jan. 25, 1993, abandoned.

[51] Int. Cl.[6] ..... A47L 9/30

[52] U.S. Cl. ..... 15/324; 15/339; 362/91

[58] Field of Search ..... 15/324, 339; 362/91

[56] References Cited

U.S. PATENT DOCUMENTS

| | | | |
|---|---|---|---|
| 2,107,016 | 2/1938 | Snyder | 15/324 |
| 3,328,820 | 7/1967 | Doersam | 15/324 X |
| 3,444,582 | 5/1969 | Erbor | 15/324 X |
| 3,646,632 | 3/1972 | MacFarland | 15/339 |
| 4,068,341 | 1/1978 | Scott et al. | 15/339 |
| 4,329,757 | 5/1982 | Ramstrom et al. | 15/339 X |
| 4,392,271 | 7/1983 | Sepke | 15/339 |
| 4,757,574 | 7/1988 | Sumerau | 15/324 |
| 4,791,700 | 12/1988 | Bigley et al. | 15/324 |
| 4,905,341 | 3/1990 | Sunagawa et al. | 15/324 X |
| 5,207,498 | 5/1993 | Lawrence et al. | 15/324 X |

FOREIGN PATENT DOCUMENTS

| | | | |
|---|---|---|---|
| 600236 | 4/1948 | United Kingdom | 15/324 |

*Primary Examiner*—Christopher K. Moore

[57] ABSTRACT

An illuminated belt view for a vacuum cleaner wherein light is transmitted, via a light pipe, from a remote light source to an area directly underneath a transparent belt view window. The transparent belt view window is formed in the vacuum cleaner hood to allow the operator to observe the operating condition of the belt therein, the belt being operable to transfer rotational motion from a motor output shaft to a rotary brush. Illumination of the belt in the area of the belt view window allows the belt and the operating condition thereof to be observed during low ambient light conditions. Use of light from the light source, which is primarily a headlight, removes the need for an independent light source for the belt view window without significantly decreasing the amount of light which is transmitted to the area in front of the machine. Also, use of a single light source for indicator illumination and headlight functions reduces the energy necessary to operate the vacuum cleaner, the heat produced by the vacuum cleaner, and manufacturing and maintenance costs by minimizing the number of light bulbs to be installed and replaced.

20 Claims, 3 Drawing Sheets

VACUUM CLEANER WITH ILLUMINATED BELT VIEW

This is a continuation of application Ser. No. 08/008,739, filed Jan. 25, 1993 now abandoned.

BACKGROUND OF THE INVENTION

FIELD OF THE INVENTION

The present invention is generally related to vacuum cleaner lighting devices and, more particularly, to devices to illuminate accessory indicators for a vacuum cleaner.

DESCRIPTION OF RELATED ART

During the development of vacuum cleaners, it has become common to include a source of light to aid the user in seeing the surface to be cleaned in low ambient light conditions. Conventionally, as shown by U.S. Pat. No. 3,444,582, the light source comprises a forwardly-mounted light source which illuminates the area in front of the vacuum cleaner. Additionally, the use of a lens to focus the light in a specific pattern relative to the vacuum cleaner is known in the art, as evidenced by U.S. Pat. No. 4,791,700.

It has also been proposed to mount the light source inwardly from the front of the vacuum cleaner and provide a light transmission means to communicate light from the remote light source to the front of the machine. U.S. Pat. No. 4,757,574 is illustrative of devices of this type wherein light from a light bulb is communicated to a front of the machine via a light plate. Light is transmitted through the light plate from an input edge to an opposite output edge, which is at the forward surface of the machine, and projects onto the surface in front of the vacuum cleaner.

In lighting systems of this type, transmitted light illuminates an area to be cleaned. There is no provision of illumination of the various indicators housed within the vacuum cleaner. Therefore, there exists a need in the art for an accessory indicator illuminator or lighting device and, more specifically, for means to communicate light from a remote light source to the vacuum cleaner accessory indicator to be illuminated.

SUMMARY OF THE INVENTION

The present invention pertains to a lighting system for a vacuum cleaner which, in addition to serving as a head light for the vacuum cleaner, illuminates one or more of the various indicators provided by the vacuum cleaner, allowing the indicator to be seen during low ambient light conditions.

In accordance with the present invention, the vacuum cleaner includes a floor engaging unit which comprises a hood and a base. A light source is mounted within the floor engaging unit and serves as a head light to illuminate an area in front of the floor engaging unit. The light source also illuminates an interior portion of the housing. Providing a single light source which functions as both a head light and an indicator light eliminates the need for an extra bulb or light source to illuminate the indicator, thereby eliminating the heat produced by another bulb, saving the energy required to illuminate the bulb, and saving manufacturing and maintenance costs.

In further accordance with the present invention, the light source is remote from the interior portion of the floor engaging unit to be illuminated. Light from the light source is communicated to the interior portion via a light communication means. Locating the light source remote from the interior portion being illuminated allows easy access to the light source for replacement.

In further accordance with the present invention, the light communication means includes a light pipe. Light projects from the light pipe and allows the visualization of the interior portion of the floor engaging unit during low ambient light conditions.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
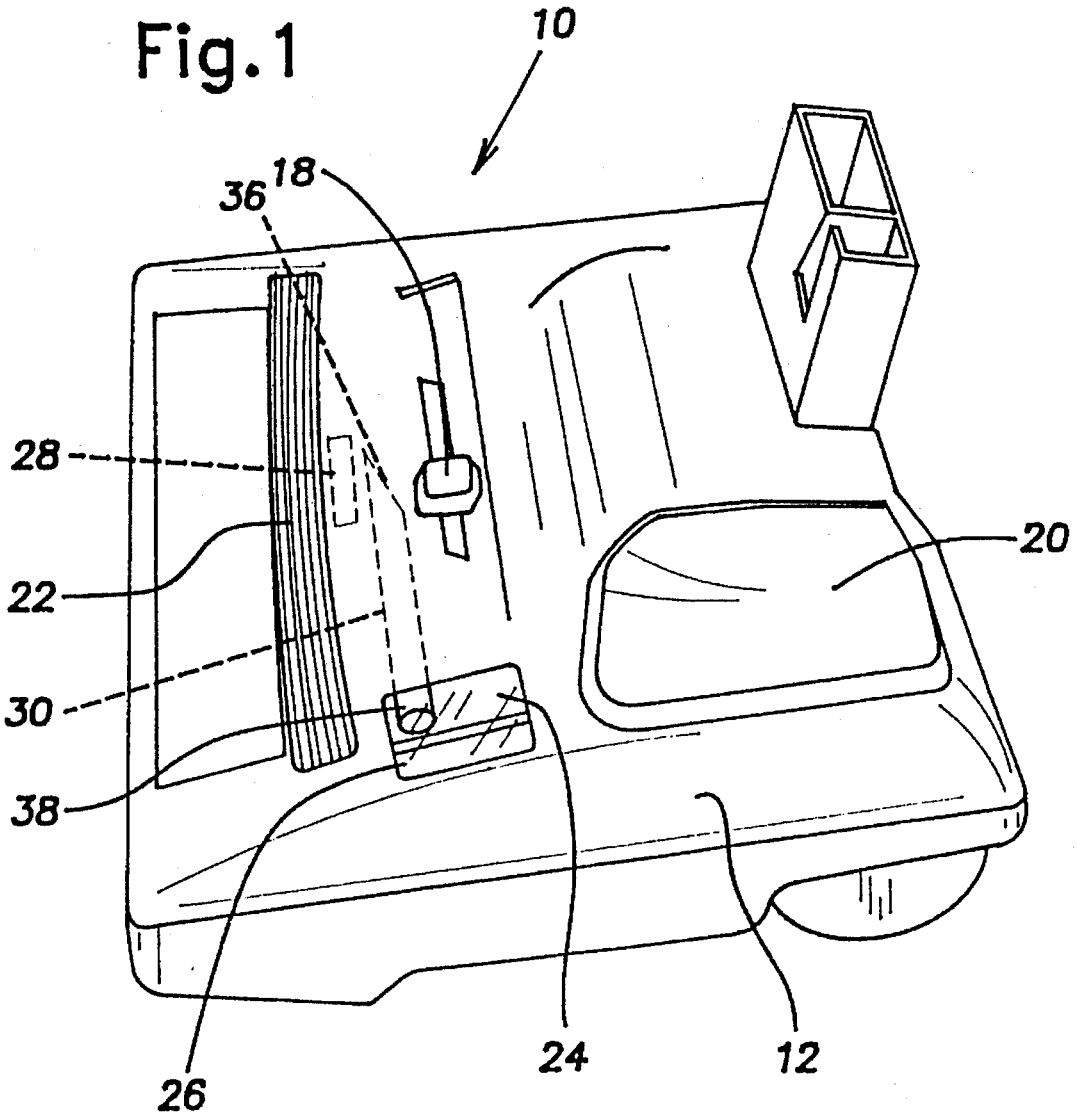
FIG. 1 is a perspective view of a floor engaging unit of a vacuum cleaner incorporating the present invention.
Figure 2:
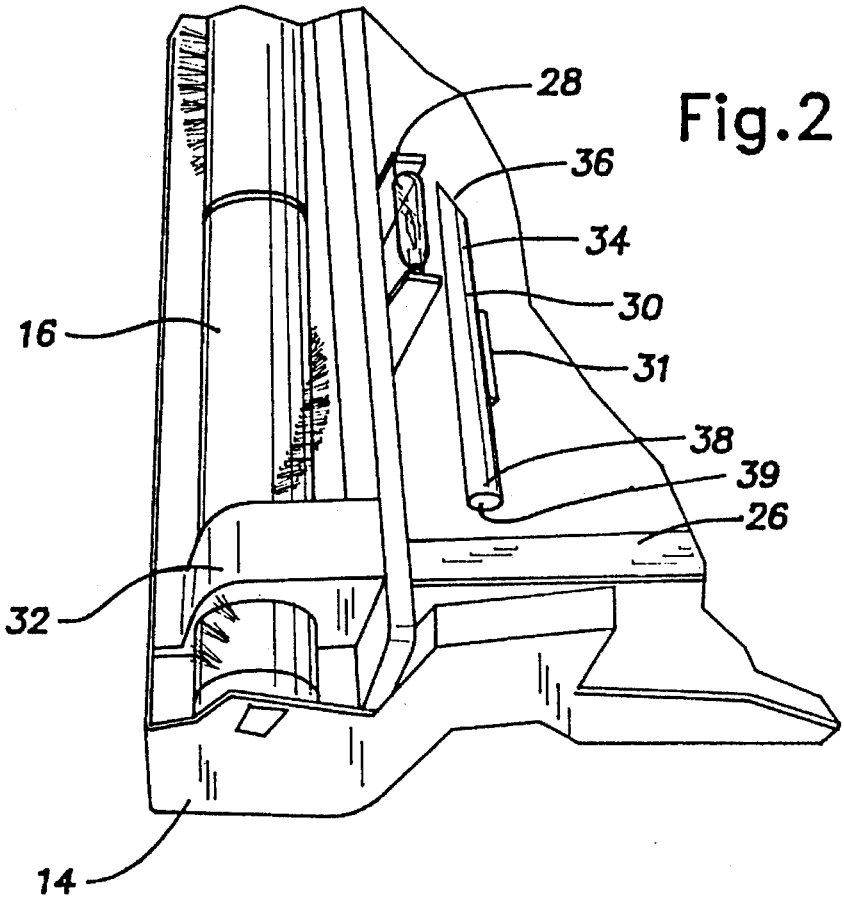
FIG. 2 is a perspective view of the interior of the floor engaging unit, with portions broken away for clarity.

With reference to the drawing figures and, in particular, FIGS. 1 and 2, a floor engaging unit 10 of a vacuum cleaner incorporating the present invention is shown. The floor engaging unit generally includes a hood 12, a base 14, and a rotary brush 16.

The hood 12, as shown best in FIG. 1, includes a height adjustment means 18, a foot switch 20, a headlight lens 22, and a transparent belt view window 24. The height adjustment means 18 is engageable and movable by a user to alter the height of the rotary brush 16 relative to a surface to be cleaned. The headlight lens 22 is adapted to focus light from an internal source downwardly on the surface in front of the floor engaging unit 10.

A belt 26, which is operable to transfer rotational force from a motor (not shown) to the rotary brush 16, is visible to the operator through the transparent belt view window 24. The belt view window 24 is preferably made of clear plastic or similar transparent medium and is snap-fit or otherwise mounted within an opening in the hood 12. The foot switch 20 allows the user to conveniently control the operation of the motor which is mounted to the base and, hence, the operating condition of the belt 26 and the rotary brush 16. Preferably, the belt 26 includes distinctive or contrasting markings (not shown) which allow moving or non-moving operating conditions of the belt to be easily discerned by the operator. Specifically, the belt 26 has contrasting markings that become a visible band of color when the belt is moving, yet define static images when the belt is stationary. It is this difference in display, which is visible to the operator via the transparent belt view window 24, that can alert the operator in the event of a malfunction to either the belt 26 or the rotary brush 16.

For a more detailed description of the components of the floor engaging unit 10, reference should be made to the commonly assigned United States patent application Ser. No. 7/962,412, the disclosure of which is expressly incorporated herein by reference. For a more detailed description of the belt view window 24 and the belt 26, reference should be made to U.S. Pat. No. 4,392,271, the disclosure of which is expressly incorporated herein by reference.

As shown best in FIG. 2, the base 12 of the floor engaging unit 10 has mounted therein the rotary brush 16, a light source or bulb 28, which primarily serves as a headlight, and a light pipe 30. The rotary brush 16 is engaged by the belt 26 at a location inwardly spaced from both ends, the area of engagement being covered by a belt cover 32. The bulb 28 is rearwardly spaced from the brush 16, being located so that a substantial portion of light produced by the bulb can be focused by the lens 22 towards the surface to be cleaned.

Figure 4:
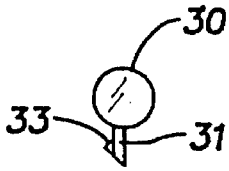
FIG. 4 is an end elevational view of the light pipe of the present invention.

As will be recognized by one skilled in the art, the light pipe 30, which is an optical plastic such as clear acrylic or the like, transmits light from the light bulb 28 to the belt 26. The light pipe 30 is rearwardly spaced from the bulb 28 and directed towards the belt 26. As shown best in FIG. 4, the light pipe 30 integrally includes an outwardly extending rib 31 which slidably fits into a mounting groove (not shown) in the base 14. The rib 31, which is offset from the centerline of the light pipe 30, includes a hooked portion 33 (FIG. 4) which is adapted to retain the rib 31 within the mounting groove.

Figure 3:
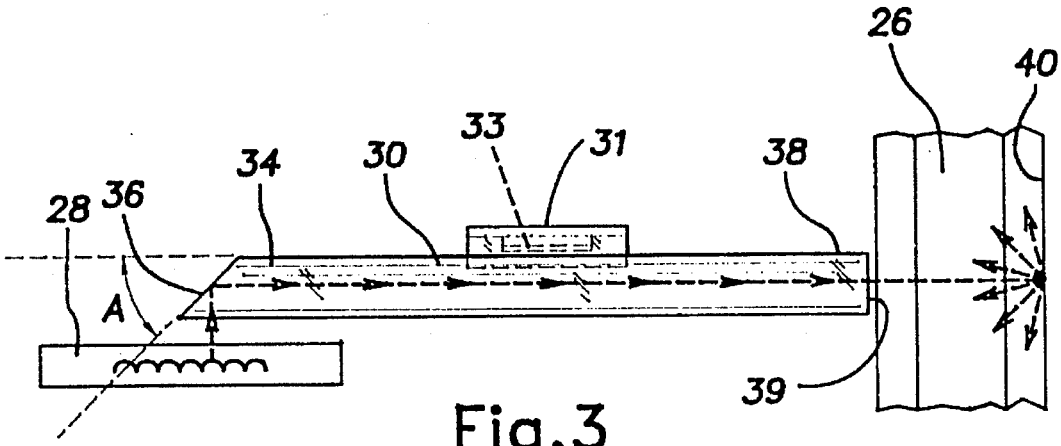
FIG. 3 is a schematic representation of the operation of the present invention.

With specific reference to FIG. 3, a first embodiment of the light pipe 30 as used to transmit light from the light bulb 28 to the belt 26 is shown.

A portion of the light from the bulb 28 is emitted rearwardly and enters a distal end 34 of the light pipe 30. For example, light can enter the distal end 34 of the light pipe 30 via an opening in a reflector (not shown).

The distal end 34 of the light pipe 30 has a beveled or angled surface 36 which reflects light internally towards a proximal end 38 of the light pipe 30. Preferably, the angled surface 36 is at an angle A with respect to the axis of the light pipe and, most preferably, the angle A is approximately 45°.

The proximal end 38 of the light pipe 30 includes a terminal surface 39 which is perpendicular to the axis of the light pipe, is adjacent the belt 26. Preferably, the terminal surface 39 is adjacent the belt 26 at a location immediately below the transparent view window 24, as shown in FIG. 1. Light projects through the terminal surface 39 provided by the proximal end 38 of the light pipe and shines upon a wall 40 adjacent the belt 26, illuminating the belt and the markings thereon. Preferably, the wall 40 is light-reflective and disperses the light in all directions to generally illuminate the area of the belt 26 visible to the operator via the belt view window 24.

Thus, light is transmitted through the light pipe 30 and illuminates the belt 26 immediately underneath the belt view window 24, allowing the operator to view the operating condition of the belt during low ambient light conditions. The light derived from the light source or bulb 28 to illuminate the belt is minimal, and there is no effective decrease in the intensity of the headlight.

Figure 5:
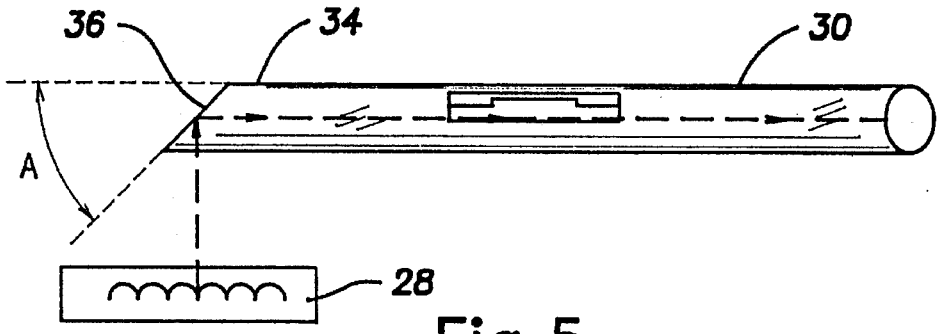
FIG. 5 is a plan view of a second embodiment of the present invention.
Figure 6:
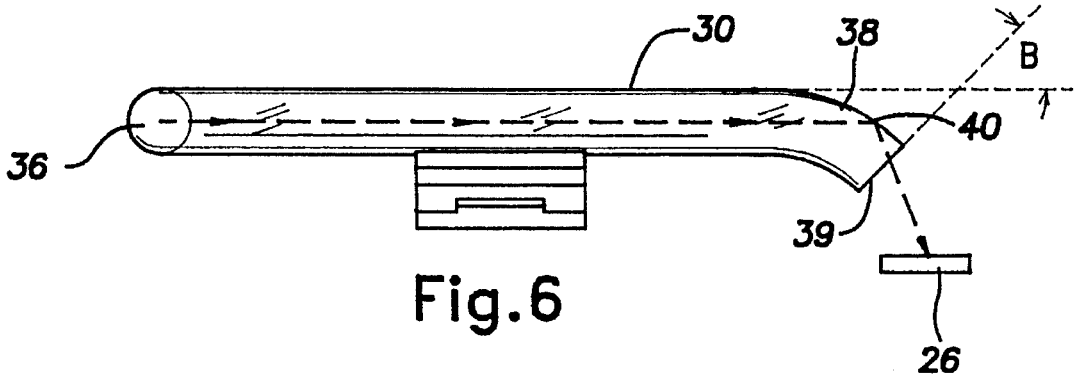
FIG. 6 is a schematic representation of the operation of the second embodiment of the present invention.
Figure 7:
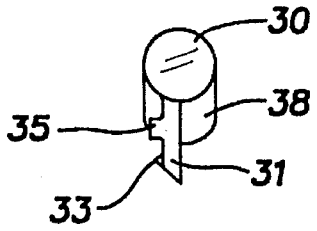
FIG. 7 is an end elevational view of the light pipe of the second embodiment present invention.

With reference to FIGS. 5–7, a second embodiment of the present invention is illustrated wherein, when appropriate, the reference numerals used to describe the light pipe of the first embodiment (FIGS. 1–4) are used.

The light pipe 30, as in the first embodiment, is preferably an optical plastic such as clear acrylic or the like, and transmits or directs light from the light bulb 28 to the belt 26. The light pipe integrally includes an outwardly extending rib 31 which slidably fits into a mounting groove (not shown) in the base 14. The rib 31, which is offset from the centerline of the light pipe 30, includes a hooked portion 33 and a tab 35 (FIG. 7) which are adapted to retain the rib within the mounting groove. Naturally, numerous mounting means can be used to mount or attach the light pipe to the base 14 without departing from the scope of the present invention.

A portion of the light from the bulb 28 is emitted rearwardly and enters a distal end 34 of the light pipe 30. The distal end 34 of the light pipe 30 has a beveled or angled surface 36 which reflects or directs light internally along the length of the light pipe towards a proximal end 38 thereof. Preferably, the angled surface 36 forms an angle A with respect to the axis of the light pipe 30 and, most preferably, the angle A is approximately 45°.

The proximal end 38 of the light pipe 30 is downwardly curved as viewed in FIG. 6, preferably having a radius of 1.125 inches (2.86 cm). Light that is directed or transmitted from the distal end 34 to the proximal end 38 of the light pipe contacts or impinges upon a curved surface 40 of the light pipe 30. The light is reflected or redirected by the curved surface 40, and projects through the terminal surface 39 towards the belt 26. Since the angle of incidence of the light hitting the curved surface 40 is below the critical angle of the material forming the light pipe, substantially all of the light transmitted from the distal end 34 to the proximal end 38 projects out of the terminal surface 39 and strikes the belt 26. The terminal surface 39 is preferably at an angle B with respect to the axis of the light pipe 30 and, most preferably, the angle B is approximately 45°.

Light transmitted by the light pipe 30 of the second embodiment is transmitted directly to the belt 26. The belt 26, as in the first embodiment, is directly beneath the transparent belt view window 24. Thus, the transmitted light illuminates the belt and allows the operator to view the belt 26 and, more specifically, the contrasting markings on the belt, when the vacuum cleaner is operated in low ambient light conditions.

In both embodiments, the light pipe 30 preferably has a diameter of approximately 0.375 inches (0.95 cm) and a length of about 4.30 inches (10.92 cm).

While the preferred embodiments of the present invention are shown and described herein, it is to be understood that the same is not so limited but shall cover and include any and all modifications thereof which fall within the purview of the invention. For example, it is clear that the present invention is not limited to the illumination of a belt, but rather can be adapted to illuminate various other indicators or physical features of the vacuum cleaner, such as, for example, a brush height indicator or a suction force indicator. Moreover, light pipes can be used to illuminate the exterior of the machine to facilitate the location and orientation of the machine in low ambient light conditions. Also, it is clear that the present invention is not limited to the specific configuration or shape of the light pipes illustrated herein.

What I claim is:

1. A vacuum cleaner comprising a floor engaging unit and light communication means, said floor engaging unit including a hood and a base, a light source having a length dimension and being mounted within said floor engaging unit and being adapted to illuminate an area in front of the vacuum cleaner, said light communication means comprising a light pipe located within said floor engaging unit adjacent said light source and adapted to transmit a portion of light produced by the light source to a secondary area which is remote from the light source, said light pipe collecting said portion of light from a substantial portion of the length of said light source, said light pipe having a longitudinal axis whereby the portion of light from said light source enters said light pipe in a direction generally perpendicular to said axis and is thereafter transmitted along said axis toward said secondary area, said secondary area being within the floor engaging unit and being visible to a user from an exterior thereof.

2. A vacuum cleaner according to claim 1, wherein the hood comprises a transparent window, said secondary area being visible from an exterior of the floor engaging unit through the window.

3. A vacuum cleaner according to claim 2, wherein said secondary area comprises a portion of a brush drive belt, wherein the provision of light to the portion of the brush drive belt allows the user to determine an operating condition of the belt in low ambient light conditions.

4. A vacuum cleaner according to claim 2, wherein said light pipe has a first end proximate to the light source into which enters the portion of light from the light source and a second end proximate to the secondary area and remote from the light source from which projects light transmitted by the light pipe.

5. A vacuum cleaner according to claim 4, wherein the first end of the light pipe has a surface at an angle with respect to the axis of the light pipe which reflects the portion of light from the light source toward the second end of the light pipe.

6. A vacuum cleaner according to claim 5, wherein the light pipe includes means for securing the light pipe to the floor engaging unit.

7. A vacuum cleaner comprising a floor engaging unit, said floor engaging unit including a hood, a base, a rotary brush mounted within the floor engaging unit and adapted to rotatably engage a surface to be cleaned, a light pipe, and a light source, wherein at least a portion of the hood is transparent and light from said light source is transmitted by said light pipe to an interior portion of the floor engaging unit which is remote from said light source, said light pipe having a longitudinal axis whereby the portion of light from said light source enters said light pipe in a direction transverse to said axis and is thereafter transmitted along said axis toward said interior portion, said interior portion having a plurality of operating conditions and being visible from an exterior of the floor engaging unit via the transparent portion of the hood, whereby illumination of the interior portion of the floor engaging unit by light transmitted through the light pipe from the light source allows an operator of the vacuum cleaner to determine the operating condition of the interior portion in low ambient light conditions.

8. A vacuum cleaner according to claim 7, wherein the light pipe includes means for reflecting the portion of light from the light source toward the interior portion of the floor engaging unit.

9. A vacuum cleaner according to claim 8, wherein the interior portion includes a part of a brush drive belt which is visible from an exterior of the floor engaging unit via the transparent portion of the hood, said brush drive belt including markings which allow the user to distinguish between rotating and non-rotating operating conditions.

10. A vacuum cleaner according to claim 9, wherein the light pipe has a first end proximate to the light source into which enters the portion of light from the light source and a second end proximate to the brush drive belt from which projects light transmitted by the light pipe, said first end providing a surface at an angle with respect to the axis of the light pipe which reflects the portion of light from the light source toward the second end of the light pipe, said second end being directed toward the drive belt whereby light projecting from the second end shines directly on the drive belt to allow the user to distinguish between rotating and non-rotating operating conditions.

11. A vacuum cleaner according to claim 8, wherein the light pipe has a first end comprising said reflecting means and into which enters the portion of light from the light source and a second end from which projects light transmitted by the light pipe, said second end being remote from the light source and proximate to the interior portion.

12. A vacuum cleaner according to claim 11, wherein the reflecting means comprises a surface provided by the first end of the light pipe, said surface being at an angle with respect to the axis of the light pipe and being operable to reflect the portion of light toward the second end of the light pipe.

13. A vacuum cleaner lighting system, comprising a light source, a vacuum cleaner accessory indicator remote and isolated from said light source, and means for transmitting a portion of light produced by the light source to the vacuum cleaner accessory indicator to allow an operating condition of an accessory to be determined during low ambient light conditions, said light transmitting means comprising a light pipe having a longitudinal axis and wherein the portion of light from said light source enters said light pipe in a direction transverse to said axis and is thereafter transmitted along said axis toward said accessory indicator.

14. A vacuum cleaner lighting system according to claim 13, wherein the accessory indicator comprises a user-visible portion of a drive belt, said belt including a pattern of markings allowing the user to distinguish between rotating and non-rotating operating conditions.

15. A vacuum cleaner lighting system according to claim 13, wherein said light pipe includes means for reflecting the portion of light from the light source toward the accessory indicator.

16. A vacuum cleaner lighting system according to claim 13, wherein said light pipe has a first end proximate to the light source and a second end remote from the light source and proximate to the accessory indicator, the portion of light from said light source enters said first end and projects from said second end onto said accessory indicator.

17. A vacuum cleaner lighting system according to claim 16, wherein the light pipe includes means for reflecting light toward the accessory indicator.

18. A vacuum cleaner lighting system according to claim 17, wherein the reflecting means are provided by the first end and include a surface angled with respect to the axis of the light pipe.

19. A vacuum cleaner lighting system according to claim 18, wherein the second end of the light pipe is curved toward the accessory indicator to allow light projecting therefrom to shine directly upon said indicator.

20. A vacuum cleaner lighting system according to claim 17, wherein said reflecting means are provided by said second end, said second end being curved toward the accessory indicator to allow light to project directly thereon.

* * * * *